US005917691A

United States Patent [19]

Kadah

[11] Patent Number: 5,917,691

[45] Date of Patent: Jun. 29, 1999

[54] FAIL-SAFE VALVE RELAY DRIVER CIRCUIT FOR GAS BURNERS

[76] Inventor: Andrew S. Kadah, 5000 Hennaberry Rd., Manlius, N.Y. 13104

[21] Appl. No.: 08/629,167

[22] Filed: Apr. 8, 1996

[51] Int. Cl.[6] ..... H01H 47/32

[52] U.S. Cl. ..... 361/154; 361/160; 361/169.1

[58] Field of Search ..... 361/152–156, 361/160, 170, 166, 168.1, 169.1; 307/116, 125, 130, 134; 340/644; 324/415, 418, 422, 423; 251/129.01; 335/220

[56] References Cited

U.S. PATENT DOCUMENTS

| | | | |
|---|---|---|---|
| 2,695,378 | 11/1954 | Irvin | 361/160 |
| 4,127,887 | 11/1978 | Tanaka et al. | 324/422 |
| 5,074,780 | 12/1991 | Erdman | 431/24 |
| 5,085,574 | 2/1992 | Wilson | 431/6 |
| 5,457,595 | 10/1995 | Baldwin | 307/117 |

*Primary Examiner*—Fritz Fleming

*Attorney, Agent, or Firm*—Trapani & Molldrem

[57] ABSTRACT

First-order failure mode arrangement for driving an actuator coil for a switch element employs a microprocessor controller and a driver circuit that includes an amplifier switching device, such as a transistor, a capacitor that ac-couples the output of the microprocessor to a control electrode of the amplifier switching device, and the actuator coil which is tied between a voltage source and an output electrode of the amplifier switching device. The microprocessor also has a capability of interrogating the on or off condition of the switch element. The switch element can be, for example, the gas valve relay for a gas furnace. The switch element can be tested to ensure that it is capable of both closing and opening when directed, and to ensure that of the switch element is not locked or frozen into a closed condition. If any of the microprocessor output, the capacitor, the switch transistor, or the coil develops a short or an open condition, the drive circuit will be unable to provide drive current to the coil, and the microprocessor will terminate the actuation sequence, and shut down.

12 Claims, 3 Drawing Sheets

FAIL-SAFE VALVE RELAY DRIVER CIRCUIT FOR GAS BURNERS

BACKGROUND OF THE INVENTION

The present invention relates to control circuits, e.g., furnace controls, and is more particularly concerned with a control circuit with a gas valve relay driver circuit which will actuate the gas valve when all components are in proper order, but will fail to actuate the gas valve otherwise. The invention is also concerned with a furnace control circuit that operates with fewer and less expensive parts than those of the prior art.

In a modern gas furnace, one or more gas burners inject a gas flame through a heat exchanger, and the combustion gases are drawn out the heat exchanger by means of an inducer blower, which exhausts the combustion gases to a vent or flue. A pressure sensor associated with the inducer actuates a pressure switch to indicate a pressure differential between the exhaust and intake of the inducer. The pressure switch provides an indication that the inducer is functioning properly.

An indoor air blower forces air from a comfort zone past the heat exchanger to draw heat from the combustion gases. The warmed air is then returned to the comfort zone. A temperature limit switch on the heat exchanger is normally closed, and opens if the heat exchanger exceeds a predetermined temperature. This limit switch serves as a check on proper air flow and functioning of the indoor air blower.

A thermostat located in the comfort zone closes when the room temperature drops below a predetermined setpoint, and thereby signals a call for heat. When a call for heat is detected, control and timing circuitry for the furnace actuates the inducer blower and then initiates an actuation sequence which actuates a gas valve relay so that current is supplied to a gas valve. This allows combustion gas to flow to the burners. At this time, igniters are actuated to light the burners, and the furnace begins to produce heat. An infrared detector, rectification or other mechanism is employed to ensure that there is flame when the gas valve is actuated. If no flame is present, another series switch interrupts the thermostat power and turns off the gas valve.

After the burners have been ignited for a predetermined time, the room air blower is powered up, and this creates a flow of warm air to the interior comfort zone.

Conventionally, 24 volt ac thermostat power is supplied through the series arrangement of the limit switch, thermostat, pressure switch, gas valve relay, and gas valve. Optionally, a pilot relay can actuate a line-powered gas valve relay.

As aforementioned, the limit switch, thermostat, and pressure switch are all disposed in series with the gas valve relay, so that no current can flow through the gas valve relay to actuate the gas valve, until the limit switch and pressure switch are both closed. This serves as a check that the room air blower and the inducer blower are functioning properly.

A safety problem can arise if any of the limit switch, pressure switch, or gas valve relay are for some reason locked into a closed condition. In those cases, the gas valve will continue to feed gas to the burners if the heat exchanger experiences overtemperature, or if the inducer fails to produce sufficient draft.

In a modern furnace control unit, such as is shown in Erdman U.S. Pat. No. 5,074,780, a microprocessor circuit has respective inputs connected to the series switches, with a separate microprocessor input coupled to the junction between each switch and the next successive switch or operating element. This means that, for each switch, the microprocessor requires a separate input circuit. As the cost of the microprocessor depends on the number of input circuits that are needed, the cost of the control circuit can become great. Also, a failure of any one of the input circuits can prevent the device from detecting a switch malfunction or failure condition.

Generally, whenever there is a call for heat, the controller should be able to check the conditions of the pressure switch and the gas valve relay before supplying current to the coil for the gas valve relay. This permits the control circuit to check for switch malfunction and indicate a service condition, if service or repair is required. In the conventional system, each switch has a connection to an associated input. As each switch goes from an open to a closed condition, the respective microprocessor input circuit goes from a low to a high level. Thus when there is a call for heat, the input circuit associated with the thermostat goes to a high, and the microprocessor then is alerted to turn on the inducer blower. This pressure switch closes after the inducer creates a pressure differential, and the associated microprocessor input goes from low to high. Then the gas valve relay is actuated, and the microprocessor input associated with the gas valve relay goes from low to high. This arrangement permits a positive check that the pressure switch and gas valve relay can both open and close.

The gas valve relay has an actuator coil with a driver circuit that is controlled by an output of the microprocessor. The gas valve relay driver circuit is typically designed so that if any of the driver components fail, the gas valve will not turn on. That is, the gas valve driver circuit must be constructed in such a way that the gas valve will not be turned on inadvertently. Clearly, this safety feature is necessary to keep the room space around the furnace from flooding with unignited gas, as that could present a danger of either suffocation or explosion.

One fail-safe gas valve driver circuit has been described in U.S. Pat. No. 5,085,574, granted Feb. 4, 1992, to Larry E. Wilson. In that arrangement, the driver circuit comprises a transistor or similar switching device with a collector load resistor coupled to a voltage source, the actuator coil for the gas valve relay, a capacitor tied in series between the collector of the transistor and the actuator coil, and a diode in parallel to the actuator coil. The furnace controller emits pulsating dc to the transistor to actuate the coil. The capacitor blocks straight dc from actuating the coil. If there is a failure, in any of these driver components either in the nature of an open or a short, the circuit will deny current through the actuator coil, and the gas valve relay will fail to close. While this circuit is rather simple and straightforward, it does have a few drawbacks. For one, the capacitor is disposed on the coil side of the transistor, so the capacitor must be capable of absorbing large amounts of current. Therefore, a large and costly electrolytic capacitor is used, typically 50 $\mu$f. Because of the high levels of current needed for the actuator coil, the pulsating dc produces a significant ripple on the capacitor. This shortens the life of the capacitor, causing frequent failures of the capacitor component. Likewise, high currents also appear across the diode, which can cause diode failure.

This system is also blind to the actual switch condition of the gas valve relay, and does not prevent gas valve actuation in the event that the gas valve or the gas valve relay contactor is frozen into a closed condition.

OBJECTS AND SUMMARY OF THE INVENTION

It is an object of this invention to provide a first-order fail-safe drive system for a gas valve or other device which will automatically revert to a shut down or interrupted mode if there is a component failure.

It is a another object to provide a first-order failure mode effect analysis arrangement which employs fewer component parts and is more rugged than arrangements of the prior art.

According to an aspect of this invention, an first-order failure mode arrangement is provided for electrically actuating a controlled device, such as the gas valve of a furnace. A controller circuit which can incorporate a microprocessor has an input sensitive to the on or off condition of the controlled switching device and an output that controllably provides a switching signal that has low, high, and pulsating conditions. An actuator coil is electromagnetically coupled to said controlled switching device, and has a first end and a second end, with the first end being coupled to a voltage source. An amplifier device has a control electrode and an output electrode, the latter being coupled to the second end of said actuator coil. The amplifier device can be a simple transistor amplifier, or can be a simple inverter circuit.

A method of actuating a switch arrangement for a controlled switching device that is associated with an operating element, e.g., gas valve, employs a controller circuit having input means sensitive to the on or off condition of the switching device, and an output that controllably delivers a low, a high, or a pulsating signal. The actuator coil is electromagnetically coupled to the controlled switching device and has a first end and a second end. The first end is coupled to a voltage source. An amplifier device has a control electrode, e.g., base, and an output electrode, e.g., collector, with the latter being coupled to the second end of said actuator coil. A capacitor ac couples the output of said controller circuit to the control electrode of said amplifier device.

To accomplish a fail-safe actuation procedure, the microprocessor associated with the controller circuit applies a high signal at the controller circuit output for at least a predetermined interval, and while doing so interrogates the on or off condition of the controlled switching device. If the input means detects that the switching device is in a closed condition after the high interval, then the microprocessor terminates the actuation sequence for the switching device. On the other hand, if the input means detects that the switch is in an open condition after this high interval, then the microprocessor continues the actuation sequence, and applies a pulsating dc signal through the capacitor to the amplifier device, which drives the coil to actuate the switching device.

The switch arrangement can favorably comprise a second controlled switching device disposed in series with the first-mentioned switching device. In this case, the controller circuit input means are also sensitive to the on or off condition of said second controlled switching device. The controller circuit further includes a second output that controllably delivers a low, a high, or a pulsating signal for actuating the second device. There is a second actuator coil that is electromagnetically coupled to the second controlled switching device and has first and second ends, the first end being coupled to a voltage source. A second amplifier device, e.g., a transistor amplifier or an inverter, has a control electrode and an output electrode, with the output electrode being coupled to the second end of said second actuator coil. A second capacitor ac couples the second output of the controller circuit to the control electrode of the second amplifier device.

With this arrangement, after the first actuation sequence as described above for the first switching device, the sequence continues by applying a high signal at the second output of said controller circuit for at least a predetermined interval. During that interval, the controller circuit interrogates the on or off condition of said second controlled switching device. If the input means detects that said second switching device is in a closed condition after this interval, then the controller circuit terminates the actuation of said second switching device. However, if the input means detects that said second switching device is in an open condition after this interval, then the actuation sequence continues, and a pulsating dc signal is applied from the second output terminal through the second capacitor to the second actuator coil to actuate the second switching device.

The respective capacitors disposed between the outputs of said controller circuit and the control electrode of said respective amplifier devices prevent the amplifier device from passing current if the output is locked into a high level. The failure of the capacitor is indicated by applying a high test level, as discussed above. If the transistor or inverter is shorted, a failure will also be indicated at this phase.

Because the capacitor is disposed at the input side of the amplifier, and not in line with the actuator coil, a small-value rugged capacitor can be used. For example, the capacitor can be an 0.010 $\mu$f non-polarized device. As a result, the capacitor is not prone to early failure, as was the case with the arrangements of the prior art as just described.

If there is a component failure, the microprocessor of the controller circuit will indicate the nature of the failure with a flashing light or LED, to guide a service professional in making repairs.

The above and many other objects, features, and advantages of this invention will present themselves to persons skilled in the art from the ensuing detailed description of a preferred embodiment of the invention, which should be read in connection with the accompanying Drawing.

DETAILED DESCRIPTION OF THE PREFERRED EMBODIMENT

Figure 1:
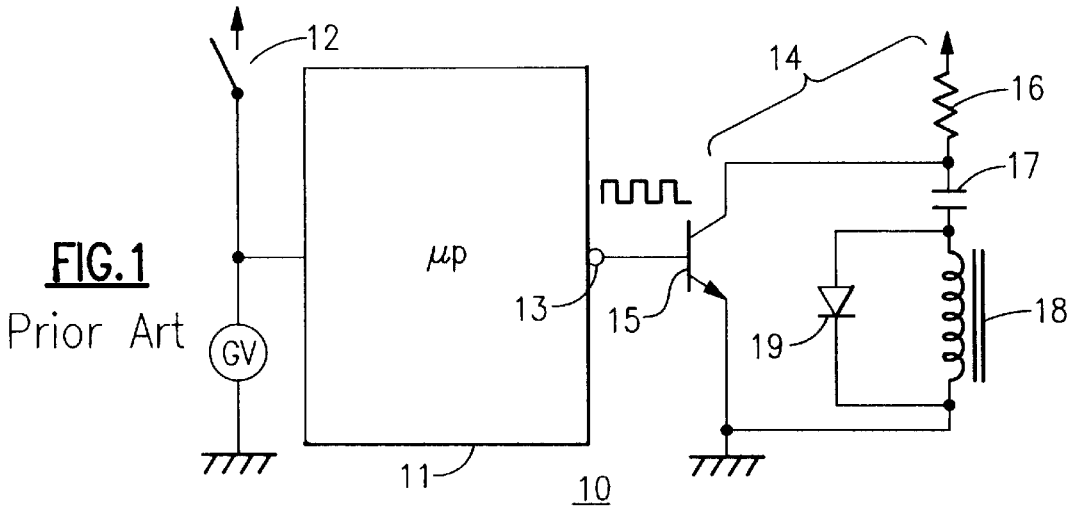
FIG.1 Prior Art
FIG. 1 is a block diagram of a microprocessor-based control circuit according to the prior art.

With reference to the Drawing, FIG. 1 illustrates a switch control arrangement 10 for a gas valve or other operating device. A microprocessor control circuit 11 is formed as an integrated circuit. An input of the microprocessor control circuit 11 is tied to the junction formed between a controlled switch 12 and an operating element, here a gas valve GV for a gas furnace. The switch 12 can be the normally-open contact of the gas valve relay. There are typically a number of switches arranged in series with the gas valve and gas valve relay, and the microprocessor 11 needs to have at least as many input circuits as there are switches to monitor. Here for simplicity only the one switch 12 is shown. An output circuit 13 of the microprocessor 11 provides pulsating dc to actuate the switch 12.

A failure mode driver arrangement 14 of the type that is currently in use, and which is described in U.S. Pat. No. 5,085,574, employs an amplifying transistor 15, here an NPN junction device, with its base tied to the output circuit 13. A load resistance 16 is tied between a positive voltage source and the collector of the transistor 15, with the emitter of this transistor being tied to ground. Between the collector and ground is a series circuit formed of a series capacitor 17 and an actuator coil 18, with a diode 19 being coupled in parallel with the coil 18. As explained in the above-noted U.S. Patent, the presence of the pulsating dc at the output 13 of the microprocessor will cause a current flow in the coil 18 and will actuate the switch 12. However, if there is component failure in the resistor 16, the capacitor 17, the diode 19, or the coil 18, the arrangement 14 will deny current through the coil 18, and will not actuate the switch 12. Also, if the transistor 15 is either shorted or open, or if the microprocessor output 13 is locked in either a high or a low condition, and the arrangement will likewise fail to actuate the switch 12. Consequently, in all failure modes the driver circuit 14 leaves the switch 12 unactuated. This is an important benefit, as it avoids inadvertent opening of the gas valve GV, which could lead to suffocation or explosion. However, as discussed previously, this circuit does have some significant disadvantages. For one thing, the arrangement requires five discrete parts, namely the load resistor 16, capacitor 17, coil 18, diode 19, and transistor 15. Operation with fewer components would increase the system reliability. Also, because the capacitor 17 must handle all the drive current that flows through the actuator coil 18, this capacitor 17 must be a high-value device, and typically a large electrolytic capacitor is used, e.g., 50 $\mu$f. The large currents flowing through the capacitor 17 and coil 18 have significant ripple, and this can have an adverse effect on the electrolytic capacitor. This can significantly shorten the life span of the large electrolytic capacitor 18. Thus, these high-value capacitors, which are usually rather expensive, can burn out rather rapidly, and have to be replaced frequently. Of course, each failure results in a furnace shut-down, which causes inconvenience and discomfort to the homeowner or others in the comfort space.

Figure 2:
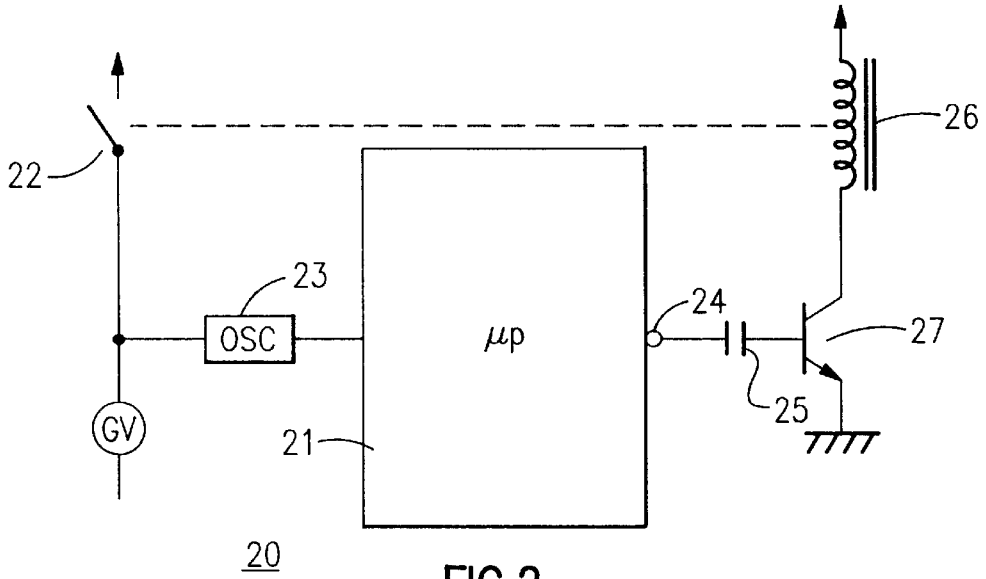
FIG. 2 is a block diagram of a control circuit according to an embodiment of the invention.

A switch control arrangement 20 according to an embodiment of this invention is shown in FIG. 2. Here a microprocessor control 21 controls the actuation of a switching element 22, such as the gas valve relay for a gas furnace. In this case a controllable oscillator 23 is tied to an input of the microprocessor control 21, and is also tied to switch 22. The oscillator produces a tone or a signal at one frequency when the switch 22 is open and at another frequency when the switch is closed. This permits the microprocessor to interrogate the switch condition by the presence or absence of a predetermined frequency or pulse rate. This also permits the microprocessor to interrogate the switch condition for multiple switches using only a single microprocessor input.

An output circuit 24 of the microprocessor 21 actuates the switch 22 using only three elements, as shown. Here a small capacitor 25 ac couples the output circuit 24 to the control terminal or base of an NPN transistor 27, whose emitter is tied to ground and whose collector is tied to one end of an actuator coil 26 for the switch 22. The other end of the actuator coil 26 is connected to a voltage source. To close the switch 22, the microprocessor output terminal 24 generates pulsating dc. The ac component of this passes through the capacitor 25 and switches the transistor 27 on and off. This causes a pulsating dc drive current to flow in the coil 26. A high or low dc signal will not pass the capacitor 25, and will not close the switch.

Figure 3:
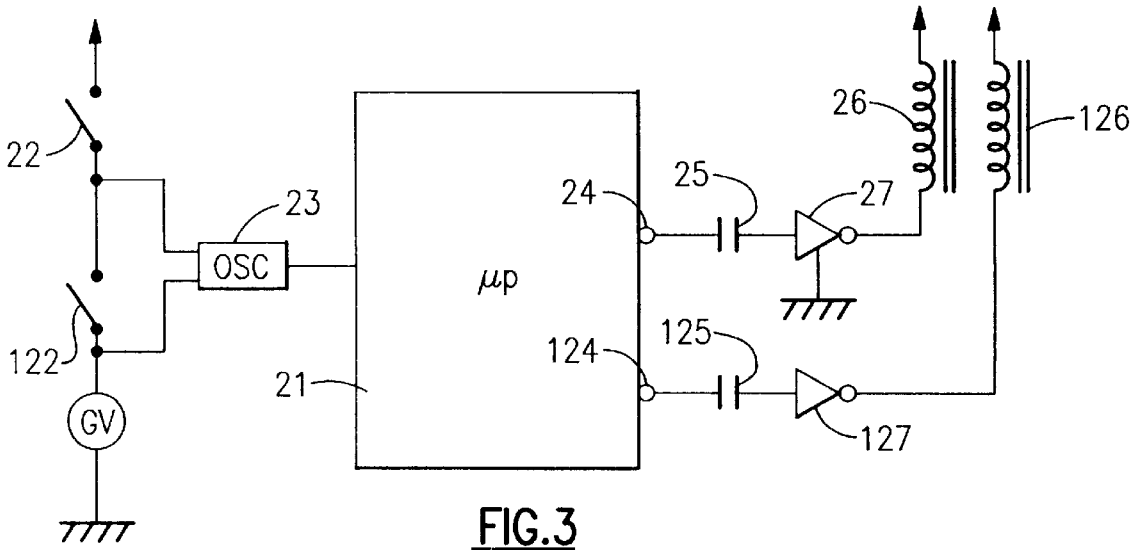
FIG. 3 is a block diagram of another embodiment of the invention, adapted for controlling a plurality of switching devices.

As shown in FIG. 3, the switch control arrangement 20 can be used for controlling the actuation of multiple switches, of which two switches 22 and 122 are here shown connected in series with the gas valve GV. The controlled oscillator 23 has respective inputs coupled to each of the switches, so that the microprocessor 21 can interrogate the switch condition of each of the switches based on the presence or absence of a predetermined frequency. For each switch 22 and 122 there is a respective actuator circuit, each of which has components of the type shown in FIG. 2. Here for switch 22, the capacitor 25 couples the output circuit 24 to an input of an inverter circuit 27', whose output is connected to one end of the actuator coil 26. Similarly, a capacitor 125 connects an output circuit 124 of the microprocessor to an input of a second inverter 127', which has its output connected to one end of an actuator coil 126 for the switch 122. This arrangement satisfies first order failure mode effect criticality analysis (First Order FMECA). The microprocessor 21 can actuate the gas valve GV only if the output circuit 24 or 124, the capacitor 25 or 125, the transistor or inverter 27, 27' or 127' and the coil 26 or 126 are all functioning properly. A failure of any one of these parts will result in a fail-safe condition in which the gas valve cannot be turned on. In the event of a failure, the microprocessor will be able to detect this condition, by action of the oscillator 23, and the microprocessor 21. Once the problem is identified, the microprocessor 21 will ignite a trouble light to display the nature of the problem.

Figure 4:
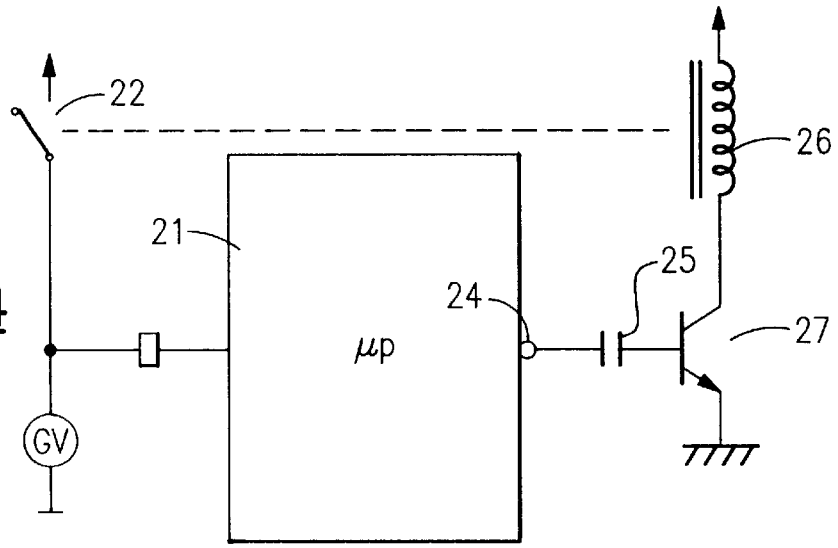
FIGS. 4, 5, and 6 are block diagrams for explaining the actuation sequence in accordance with an embodiment of the invention.
Figure 5:
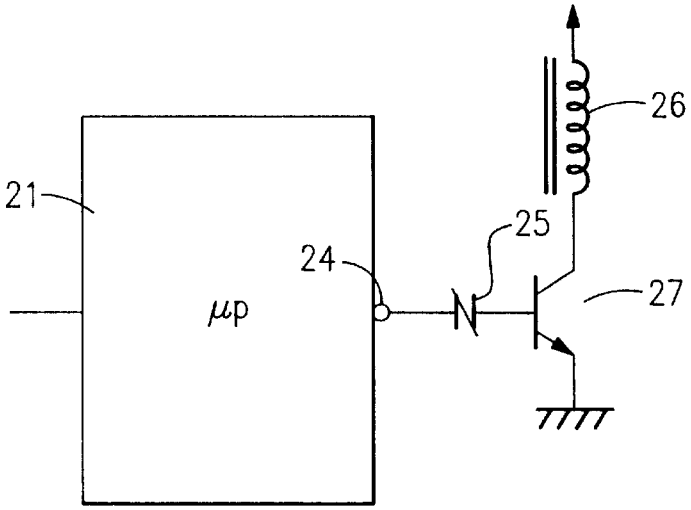
Figure 6:
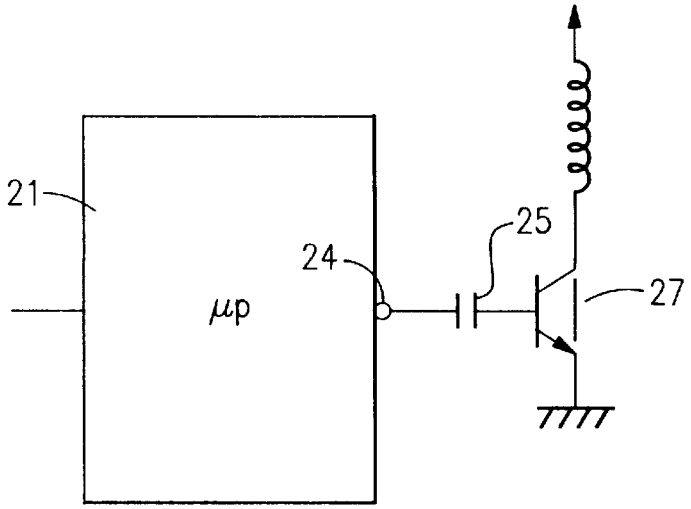
Figure 7A:
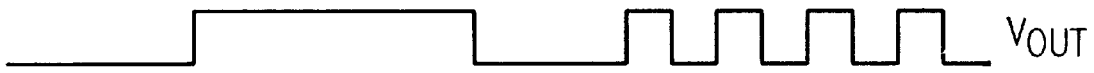
FIGS. 7A, 7B, and 7C are signal diagrams for explaining the actuation sequence of this invention.
Figure 7B:
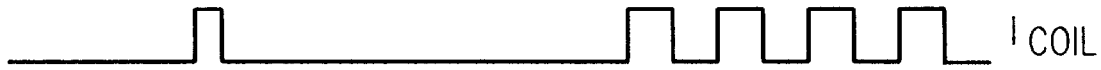
Figure 7C:
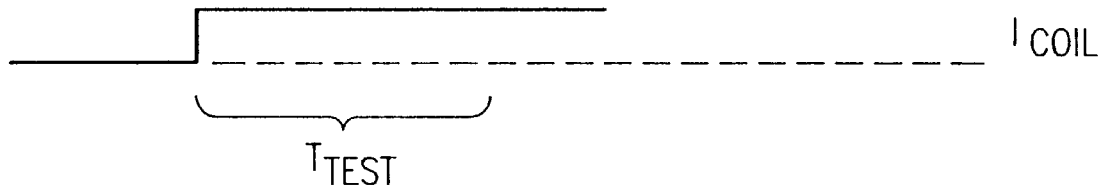

The actuation sequence for each of the switches can be described with reference to the schematics of FIGS. 4, 5, and 6, and the signal charts of FIGS. 7A, 7B, and 7C. When there is a call for heat, and the microprocessor 21 is alerted to actuate the switch 22, the output 24 first generates a test level, that is a high dc level, for a predetermined period of time $T_{TEST}$, e.g., one second, as shown in FIG. 7A. Then the output circuit 24 reverts to a low dc level for a brief period of time, e.g., one second. During this time the microprocessor interrogates the condition of switch 22 to test whether it is open or closed. As shown in FIG. 7B, when the microprocessor 21, capacitor 25, transistor 27 and coil 26 are all in proper operating condition (as shown in FIG. 4), the onset of the high level (FIG. 7A) will produce only a brief pulse of current during the time that the capacitor 25 is charging. However, if there is a short in the capacitor 25 (FIG. 5), the transistor 27 will create a positive current flow in the coil 26 (FIG. 7C). Likewise, if there is a short across the transistor 27 (FIG. 6), there will be a positive current flow in the coil regardless of the signal at the microprocessor output 24. During the predetermined period when the continuous high level is present, the microprocessor interrogates the switch condition. If the switch 22 is detected to be on, then the actuation sequence is terminated, and the microprocessor goes to a fault mode. Also if the switch 22 is detected to be on during the period when the output circuit 24 has a continuous low level, the actuation sequence is terminated and the microprocessor also goes to a fault mode. However, if the switch condition is detected as off during this test period, then the microprocessor output 24 produces pulsating dc $V_{OUT}$ (FIG. 7A). This passes through the capacitor 25 and causes the transistor 27 to drive the coil 26 with pulsating current $I_{COIL}$ (FIG. 7B). This can have a pulse frequency of 10 KHz, for example. At this time the microprocessor again interrogates the condition of the switch 22, and if the condition is detected as closed, then the microprocessor proceeds to actuate further switches, e.g., 122. However, if the switch 22 is now detected as open, then the microprocessor 21 interrupts the actuation sequence and produces a fault indication. This condition will mean that there is an open in the capacitor 25, the transistor 27 or the coil 26. In the event of any detected failure, the microprocessor can light an appropriate LED or other indicator, so that a service representative can identify the problem and quickly remedy or repair it.

After the first switch 22 has been properly actuated in accordance with the above procedure, the microprocessor employs a similar procedure to actuate the next switch 122 and any further switches. Only after each switch has been interrogated and each actuation arrangement has been detected to have its components in proper order is the gas valve GV turned on. This arrangement provides the optimal fail-safe operation to prevent unintended opening of the gas valve. On the other hand, the actuation arrangement operates with fewer components and avoids having to use a large capacitor to handle the fill drive current for the actuation coil. This creates a higher level of reliability and longer working life than the arrangements of the prior art.

Rather than an electromagnetic relay, a solid-state relay could be used, with an LED or optical actuator employed in lieu of the coil 26, and used in connection with an optical device, such as a phototriac. Other equivalents could also be used.

While the invention has been described here in reference to a preferred embodiment, it should be recognized that the invention is not limited to that embodiment. Rather, many modifications and variations will present themselves to persons skilled in the art without departure from the scope and spirit of this invention, as defined in the appended claims.

I claim:

1. Fail-safe arrangement for electrically actuating a controlled switching device, comprising (A) a controller circuit having an input sensitive to the on or off condition of said switching device and an output that controllably provides a switching signal that has three states, namely a steady low, a steady high, and a pulsating state;

(B) an actuator that is coupled to said controlled switching device, and having a first end and a second end, the first end being coupled to a voltage source;

(C) an amplifier device having a control electrode and an output electrode, the latter being coupled to the second end of said actuator; and (D) a capacitor disposed in line between the output of said controller circuit and the control electrode of said amplifier device;

wherein said controller circuit includes means for applying said signal at said steady high state at the output of said controller circuit for at least a predetermined interval and interrogating the on or off condition of said controlled switching device during said interval; and wherein if the input means detects that said switching device is in a closed condition after said interval, then terminating actuation of said switching device; but if the input means detects that said switching device is in an open condition after said interval, then continuing said actuation, and applying said signal in said pulsating state from said output through said capacitor to said amplifier device and said coil to actuate said switching device.

2. Fail-safe arrangement according to claim 1, wherein said amplifier device comprises a junction transistor.

3. Fail-safe arrangement according to claim 1, wherein said amplifier device comprises an inverter.

4. Fail-safe arrangement according to claim 1, wherein said switching device is a gas valve relay for a gas valve of a furnace.

5. Fail-safe arrangement according to claim 1, wherein said input of said controller circuit is coupled to said switching device.

6. Fail-safe arrangement according to claim 1, further comprising controllable oscillator means coupled to said switching device and to the input of said controller circuit.

7. Fail-safe arrangement according to claim 1, wherein said controller circuit has a second output, and further comprising a second actuator that is coupled to a second switching device, and having a first end and a second end, the first end being coupled to said voltage source; a second amplifier device having a control electrode and an output electrode, the latter being coupled to the second end of said second actuator; and a second capacitor that capacitively couples the second output of said controller and the control electrode of said second amplifier device.

8. A method of actuating a switch arrangement comprising a controlled switching device that is associated with an operating element, employing a controller circuit having input means sensitive to the on or off condition of said switching device, and an output that controllably delivers an output signal at a selected one of three output states, namely a steady low, a steady high, or a pulsating state; an actuator that is operatively coupled to said controlled switching device and having a first and a second end, the first end being coupled to a voltage source; an amplifier device having a control electrode and an output electrode, the latter being coupled to the second end of said actuator, and a capacitor for ac coupling the output of said controller circuit to the control electrode of said amplifier device; the method comprising:

applying said signal at said steady high state at the output of said controller circuit for at least a predetermined interval and interrogating the on or off condition of said controlled switching device during said interval;

if said input means detects that said switching device is in a closed condition after said interval, then terminating actuation of said switching device; but if the input means detects that said switching device is in an open condition after said interval, then continuing said actuation, and applying said signal at said pulsating state from said output through said capacitor to said amplifier device and said coil to actuate said switching device.

9. The method of claim 8, wherein the switch arrangement comprises a second controlled switching device disposed in series with the first-mentioned switching device, said controller circuit input means are sensitive to the on or off condition of said second controlled switching device, and further includes a second output that controllably delivers a signal at a low, a high, or a pulsating state; a second actuator that is operatively coupled to said second controlled switching device and has first and second ends, the first end being coupled to a voltage source; a second amplifier device having a control electrode and an output electrode, the latter being coupled to the second end of said second actuator, and a second capacitor for ac coupling the second output of the controller circuit to the control electrode of the second amplifier device; and said method further comprising:

applying said signal at said high state at the second output of said controller circuit for at least a predetermined interval and interrogating the on or off condition of said second controlled switching device during said interval;

if said input means detects that said second switching device is in a closed condition after said interval, then terminating actuation of said second switching device, but if the input means detects that said second switching device is in a open condition after said interval, then continuing said actuation, and applying said signal at said pulsating state from said second output terminal through said second capacitor to said second actuator coil to actuate said second switching device.

10. The method of claim 8, wherein said predetermined interval is on the order of one second.

11. Fail-safe arrangement for electrically actuating a controlled switching device, comprising (A) a controller circuit having an input sensitive to the on or off condition of said switching device and an output that controllably provides a switching signal that has low, high, and pulsating conditions;

(B) an actuator that is coupled to said controlled switching device, and having a first end and a second end, the first end being coupled to a voltage source;

(C) an amplifier device having a control electrode and an output electrode, the latter being coupled to the second end of said actuator; and (D) a non-polarized small value capacitor disposed in line between the output of said controller circuit and the control electrode of said amplifier device;

wherein said controller circuit includes means for applying said signal at said high state at the output of said controller circuit for at least a predetermined interval and interrogating the on or off condition of said controlled switching device during said interval; wherein if the input means detects that said switching device is in a closed condition after said interval, then terminating actuation of said switching device; but if the input means detects that said switching device is in an open condition after said interval, then continuing said actuation, and applying said signal in said pulsating state from said output through said capacitor to said amplifier device and said coil to actuate said switching device.

12. Fail-safe arrangement according to claim 11, wherein said capacitor has a value of about 0.01 microfarads.

* * * * *